US007055984B2

(12) United States Patent
Bryce

(10) Patent No.: US 7,055,984 B2
(45) Date of Patent: Jun. 6, 2006

(54) CANDLEHOLDER

(76) Inventor: Corazon Bryce, 4081 Chelmsford Ct., Mississauga, Ontario (CA) L5B 2X2

( * ) Notice: Subject to any disclaimer, the term of this patent is extended or adjusted under 35 U.S.C. 154(b) by 89 days.

(21) Appl. No.: 10/734,832

(22) Filed: Dec. 12, 2003

(65) Prior Publication Data

US 2004/0125598 A1 Jul. 1, 2004

(30) Foreign Application Priority Data

Dec. 16, 2002 (CA) ..... 2414451

(51) Int. Cl.
*F21L 19/00* (2006.01)

(52) U.S. Cl. ..... 362/161; 362/162; 431/295

(58) Field of Classification Search ..... 362/161, 362/162, 373, 392; 431/295; D26/9
See application file for complete search history.

(56) References Cited

U.S. PATENT DOCUMENTS

| | | | | |
|---|---|---|---|---|
| 610,194 | A * | 9/1898 | Neil | 362/162 |
| 1,388,267 | A | 8/1921 | Kneip | |
| 1,698,043 | A * | 1/1929 | Wise et al. | 431/152 |
| 2,001,312 | A | 5/1935 | O'Connell | |
| 2,072,692 | A | 3/1937 | Valle | |
| 3,334,218 | A | 8/1967 | Nawrocki | |
| 3,434,235 | A | 3/1969 | Gordon et al. | |
| 4,224,017 | A | 9/1980 | Kayne | |
| 4,787,017 | A | 11/1988 | Vrettos | |
| 5,055,035 | A | 10/1991 | Hancovsky | |
| 5,683,239 | A | 11/1997 | Cardosi | |
| D388,522 | S * | 12/1997 | Pietrantoni | D26/9 |
| 5,803,587 | A | 9/1998 | Chen | |
| 2004/0086815 | A1 * | 5/2004 | Hermanson | 431/126 |

* cited by examiner

*Primary Examiner*—Alan Cariaso
*Assistant Examiner*—James W Cranson, Jr.
(74) *Attorney, Agent, or Firm*—Young & Basile, P.C.

(57) ABSTRACT

Candleholders suitable for outdoor use include a base unit for holding a candle, this unit having a candle supporting surface and an upstanding wall portion, and a separate cover member for placement over the candle or candles and the base unit. The cover member forms a top and a peripheral wall section. The candleholder has a plurality of openings located between the supporting surface and the top. The preferred openings are formed by partially cutting out and bending small sections of one of the upstanding wall portion and the wall section inward so as to permit entry of combustion air while also normally changing the direction of airflow of the incoming air. In one version, there is also a main housing adapted for mounting below ground level, this housing having an open top and a peripheral side wall portion that extends upwardly from a concrete bottom.

6 Claims, 10 Drawing Sheets

CANDLEHOLDER

BACKGROUND OF THE INVENTION

This invention relates to candleholders, including candleholders suitable for outdoor use such as at a gravesite, a memorial, a garden or a campsite and also candleholders for indoor use, such as in a church or place of worship.

A variety of candleholders, including ones that include some form of cover for the candle or candles are already known and used. For example, candle stick holders are commonly used in homes so that candles can be lit and held safely when they are used as needed or desired. These candleholders can take a variety of forms and they are often quite decorative in nature. For example, candle stick holders made of glass, crystal and decorative metal such as silver or silver plate are well known.

It is also known to provide candleholders for use outdoors which are not only able to hold one or more candles but are also able to cover the candle or candles to provide some protection from the wind and weather. These candle holders can come in a variety of shapes and sizes and they can be provided with one or more glass sidewalls so that the candle and its light can be seen. If the candleholder is in the form of an enclosure with a closed off top, some form of holes must be provided for ventilation purposes or otherwise the candle will quickly extinguish itself for lack of oxygen. One known difficulty with some candleholders currently on the market is that the holes in the enclosure often are provided for decorative purposes and therefore they are arranged and sized in such a manner that they provide little protection from the wind. With candleholders of this type, there is a substantial risk of the candle being quickly blown out.

Another known difficulty with known memorial candleholders designed for outdoor use is that they can be reasonably expensive in view of the types of materials used for their manufacture and therefore they are not particularly suited for one or two occasions when their use is desired. Also, because of the expense of these candleholders, the owners of these candleholders may be reluctant to leave them at a memorial or gravesite for fear that they will be damaged or possibly stolen. Also, there is a difficulty that many cemeteries fail to provide any storage facility for memorial candleholders designed for use over a long period of time or on many occasions.

One early form of lantern or candleholder designed to be mounted on the ground outside is taught in U.S. Pat. No. 1,388,267 issued Aug. 23, 1921 to E. C. Kneip. This candleholder includes a base section with a horizontal plate and a downwardly extending, cylindrical support that can be pushed into the ground. The candle or candle container is placed in the center of the horizontal plate and is surrounded by an annular wall. The wall helps to hold the bottom of a chimney, the vertical sides of which can be made from transparent glass. The chimney is covered with a conical hood and air holes are provided near the top of the chimney. Difficulties with this device include the fact that it or at least a portion thereof can be readily removed or stolen by persons other than the owner if left at a gravesite and, because of its use of a glass chimney it might be easily broken, particularly by a vandal.

A more recent memorial light apparatus is that taught in U.S. Pat. No. 4,787,017 which issued Nov. 22, 1988. In this memorial light system, there is a base box with a hinged lid, the box having a size sufficient to accommodate a lantern or candleholder. The base box is designed to be mounted underground with only its top section projecting above ground level. The lantern structure has vertically extending sidewalls that can be made of glass or a high temperature plastic. Ventilation holes are formed in the base of the lantern enclosure. A metal attachment member is provided in the center of the base box lid and this can be used to secure the lantern in place on top of the lid when it is desired to use same. Although this known memorial light system overcomes some of the deficiencies in earlier candleholder units, it still suffers from some deficiencies including the cost of building same and inadequate ventilation openings for the candle or candles. Also, if glass is used for the lantern body, the lantern body may be subject to damage, particularly when it is mounted in the exposed position on top of the base box.

It is one object of one aspect of the invention tp provide an improved candleholder that is formed with unique openings located between the candle supporting surface and the top of the candleholder, these openings permitting good ventilation while at the same time allowing the candle(s) to be seen.

The candleholders described herein can provide advantages over existing candleholders, particularly those designed for use outdoors such as at a grave site. For example, according to one preferred embodiment, the candleholder can be made quite inexpensively while at the same time having a pleasing appearance and providing proper ventilation for the candle or candles. In a particularly preferred embodiment of the inexpensive candleholder, the ventilation holes are arranged and constructed in a manner that helps to prevent a gust of wind or a steady blowing wind from blowing the candle out.

In another version of the present candleholders, the candleholder is provided with a main housing which is adapted for mounting below ground level and which can be used for storing the remainder of the candleholder including a cover section in a unique manner when the candleholder apparatus is not in use.

SUMMARY OF THE INVENTION

According to one aspect of the invention, a candleholder includes a base unit for holding a candle, this base unit providing a horizontally extending support surface for a candle and having an upstanding wall portion extending upwardly from the support surface. The candleholder also includes a separate, non-combustible cover member for placement over the candle and for mounting on the base unit during use of the candle holder. The cover member forms a top and has a peripherally extending wall section that extends downwardly from the top. The candleholder formed by the combination of the base unit and the cover member has a plurality of openings located between the support surface and the top, each opening formed by partially cutting out and bending inward a small section of one of the upstanding wall portion and the peripherally extending wall section so as to permit air either to enter through or exit out of the opening while also changing the direction of airflow of incoming air in order to help prevent the candle from being extinguished. At least some of these openings are located at a height corresponding approximately to the height of the candle when the candle is mounted on the support surface so that the candle flame can be seen through at least some of the openings during use of the candleholder. During use of the candleholder, the upstanding wall portion engages the peripherally extending wall section and thereby acts to hold the cover member on the base unit.

In the preferred embodiment of this candleholder, the base unit has an outwardly projecting rim extending around the exterior of the wall portion.

According to another aspect of the invention, a candleholder apparatus for use outdoors includes an exterior housing adapted for mounting in the ground below ground level, this housing including a top with a relatively large opening formed therein, a bottom, and a peripherally extending sidewall portion extending between the top and the bottom. There is also a tray section having an upright horizontal position for supporting one or more candles on an upwardly facing first side of the tray section and an upside down horizontal position for covering the opening in the housing. A separate cover section is also provided for placement over the one or more candles and on the tray section in the upright position. This cover section has a top, an open bottom, and a periphery extending sidewall extending between the top and the bottom of the cover section. The cover section is formed with openings for air to flow into and out of a candle holding space formed by the cover section. The cover section can be inserted substantially through the opening in the housing for storage in the housing and the tray section can then be used in the upside down position to cover both the cover section and the opening in the housing.

Preferably, the exterior housing includes a base portion made of concrete and forming the bottom of the housing. A preferred form of the tray section includes a flat metal plate providing the first side for supporting the one or more candles and a wall portion which extends upwardly when the tray section is in the upright, horizontal position and which is connected to the metal plate.

According to another aspect of the invention, a candleholder apparatus for use outdoors includes a housing adapted for mounting in or on the ground, this housing including a top end with an opening therein, a bottom end, and a peripherally and vertically extending sidewall portion that extends between the top end and the bottom end. A tray section is provided which is capable of supporting one or more candles on an upper side thereof during use of the candleholder apparatus while being mounted on the top of the housing. A cover section is adapted for placement over the one or more candles and on the tray section during use of the candleholder. The cover section has a top, and open bottom, and a peripherally and vertically extending sidewall portion extending between the top and bottom of the cover section. The cover section is formed with ventilation holes and with outwardly extending flange members at its bottom for supporting the cover section in an upside down position on the housing. The cover section can be stored in the housing in the upside down position by insertion through the opening in the top of the housing. In this position, the flange devices rest on an upper edge section of the housing.

According to still another aspect of the invention, a candleholder for mounting on a vertical support surface includes a tray section adapted for holding a candle, the tray section providing a substantially flat candle-supporting surface and having a wall portion extending upwardly from the candle-supporting surface. There is a separate, non-combustible cover section for placement over the candle and the tray section during use of the candleholder, the cover section including an open bottom and a peripherally-extending sidewall portion formed with a plurality of openings, each opening being defined in part by a small section of the sidewall portion that is bent inwardly on one side of the respective opening. Each small section is adapted to change normally an initial direction of airflow of air entering through its respective opening in order to prevent the candle from being extinguished. The openings are located at a height corresponding approximately to the height of the candle when the candle is mounted on the candle-supporting surface so that the candle can be seen through one or more of the openings during use of the candleholder. An arm mechanism is provided to mount the tray section and the cover section on the vertical support surface. During use of the candleholder the wall portion of the tray section fits within the sidewall portion.

Further features and advantages will become apparent from the following detailed description taken in conjunction with the drawings.

DETAILED DESCRIPTION OF PREFERRED EMBODIMENTS

With reference to the candleholder illustrated by FIGS. 1 to 6, this candleholder is indicated generally at 10 and includes a metal cover section 12 for placement over the candle or candles and a metal tray 14. This particular candleholder has a rectangular configuration but other configurations such as cylindrical are also possible as explained further hereinafter. The metal tray 14 forms a bottom for the candleholder and provides means for holding a candle or candles such as the two small candles 16 and 18 illustrated in FIG. 6. The illustrated preferred tray as well as the cover section 12 can be made inexpensively using either heavy-duty aluminum foil or thin aluminum sheet (similar to that used in pop cans) and, when made in this manner, the candleholder can be considered disposable and used one time only or it may, if desired, be used a number of times. Because it is made of aluminum or aluminum alloy, it will not rust and can be therefore used and left outdoors. If desired, the metal can be tinted a bronze, gold or grey metallic colour or it can be plain aluminum without colour. It is also noted herein that this material is recyclable.

Figure 6:
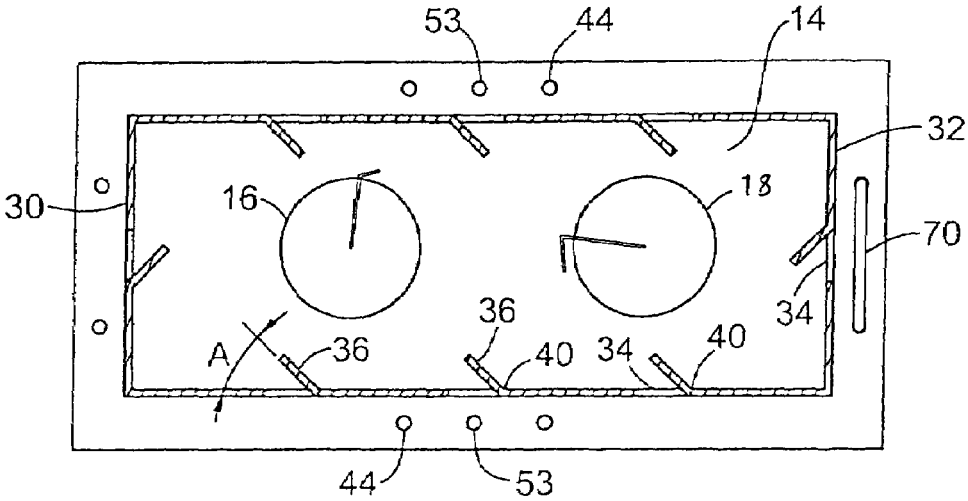
FIG. 6 is a horizontal cross-sectional view of the candleholder of FIG. 1, this view being taken along the line VI—VI of FIG. 1.

The illustrated cover section 12 includes a closed top 20, an open bottom 22 and a peripherally extending sidewall portion 24 that extends downwardly from and is joined to the top 20. Because the top 20 is at least substantially closed, candles placed in the candleholder are effectively protected from weather conditions such as rain and snow. The illustrated sidewall portion 24 includes in fact four vertical walls including two parallel longitudinal walls 26 and 28 and two vertical end walls 30 and 32. Each of these vertical walls can be provided with one or a plurality of ventilation openings 34 in one or more horizontally extending rows. Although it is preferred to have these openings on all four sides so as to ensure adequate ventilation for the candle or candles and so that the light of the candle can be readily seen, it is also possible to have the openings 34 on only two or three sides of the cover section. As illustrated, there are three of the openings 34 formed in a single, horizontal row along each longitudinal wall 26, 28 and there is also a single opening 34 in each end wall. The preferred, illustrated opening is formed by partially cutting out and bending inward a small section 36 of the sidewall portion so as to permit air for combustion either to enter through or exit out of the opening. In addition, by constructing the opening 34 in this manner, the bent section 36 also normally changes the initial direction of air flow of incoming combustion air and this helps prevent the candle from being extinguished by either a steady wind or a gust of wind. Preferably the bent sections 36 are bent in the same manner and at the same side of the openings 34 so that the air flow is directed in one direction for smooth circulation of air in the candleholder. The amount by which the small section 36 is bent inwardly can vary may depend on such factors as the expected wind conditions and the need for or desirability of seeing the candle or its light. The amount by which the small section 36 is bent inwardly is indicated in FIG. 6 by the angle A and preferably this angle ranges between thirty degrees and sixty degrees relative to the plane of the wall from which the small section 36 is bent. In the illustrated preferred embodiment, the angle A is about forty-five degrees. Also, as illustrated, the shape of the ventilation openings 34 is preferably a crescent shape with the wall portion being cut along a curved arc 38 that may extend through 180 degrees relative to a center point for the cut. Each small section 36 is bent along a diametrical or base line 40 which is a straight line. It will be appreciated that when the candleholder is constructed as a disposable device made of thin aluminum foil or thin aluminum sheet, it is easy for the user of the candleholder to change the angle of bend of one of more of the small sections 36 if he or she desires to do so. Other shapes for the ventilation openings are also possible, for example, a rectangle or square cut along three sides. It is possible to form more ventilation openings, if desired, and the amount of ventilation opening used will depend to some extent on the side of the candleholder.

The preferred cover section 12 also includes an outwardly extending peripheral flange 42. In the illustrated embodiment, the flange 42 extends completely around the bottom end of the cover section 12. It is also possible for the flange to be only formed on one, two or three sides of the cover section. If desired, suitable words, such as peace sentiments, can be printed or painted on the flange 42. In one embodiment, the width of the flange on each side is 1.5 cm but it can be wider, if desired. For attachment and anchoring purposes, the flange 42 can be provided with pairs of attachment holes 44. As illustrated, there is one pair of attachment holes 44 on each of the four sides of the cover section but it will be appreciated that there could be more attachment holes on each side if desired or attachment holes could be provided on fewer sides, for example, only two opposing sides. Optionally, two or more screw holes 53 can be provided in the flange 42 to permit the tray to be secured by screws to an in-ground housing such as that shown in FIG. 17 and described hereinafter.

Figure 1:
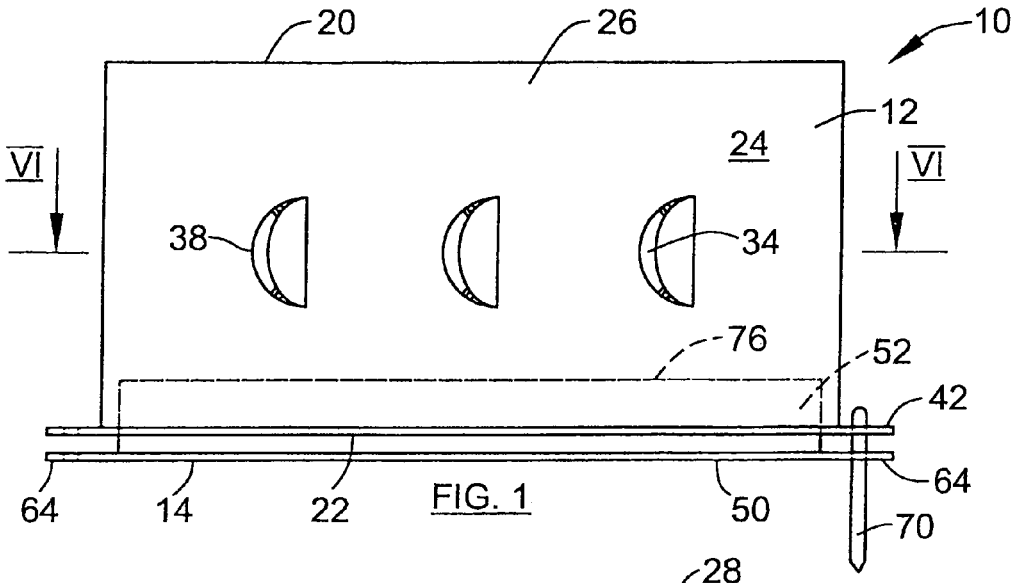
FIG. 1 is a side elevation of a first embodiment of candleholder, this view showing one anchor post mounted on the candleholder.
Figure 2:
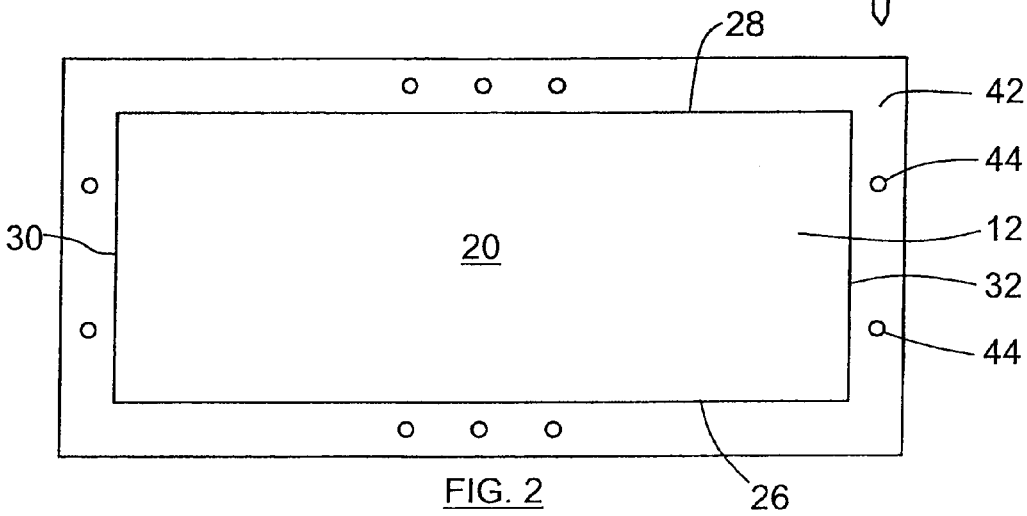
FIG. 2 is a top view of the candleholder of FIG. 1.
Figure 3:
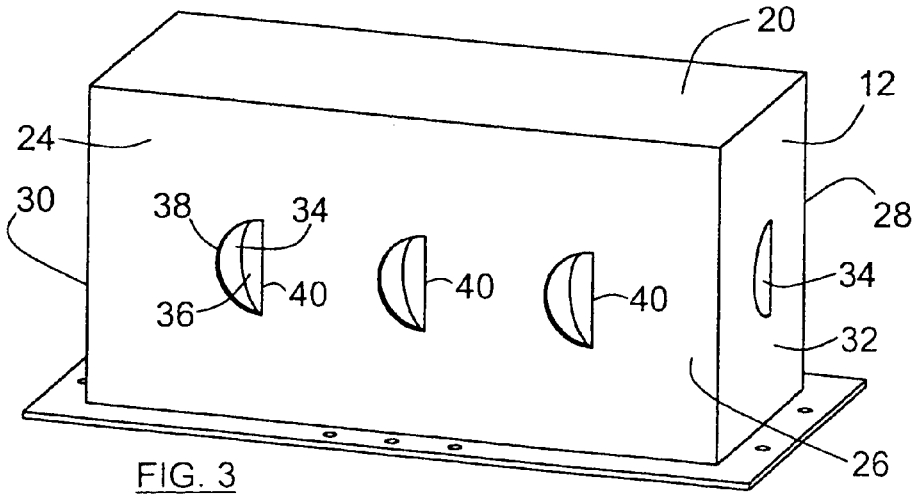
FIG. 3 is a perspective view of the cover section of the candleholder of FIG. 1.
Figure 4:
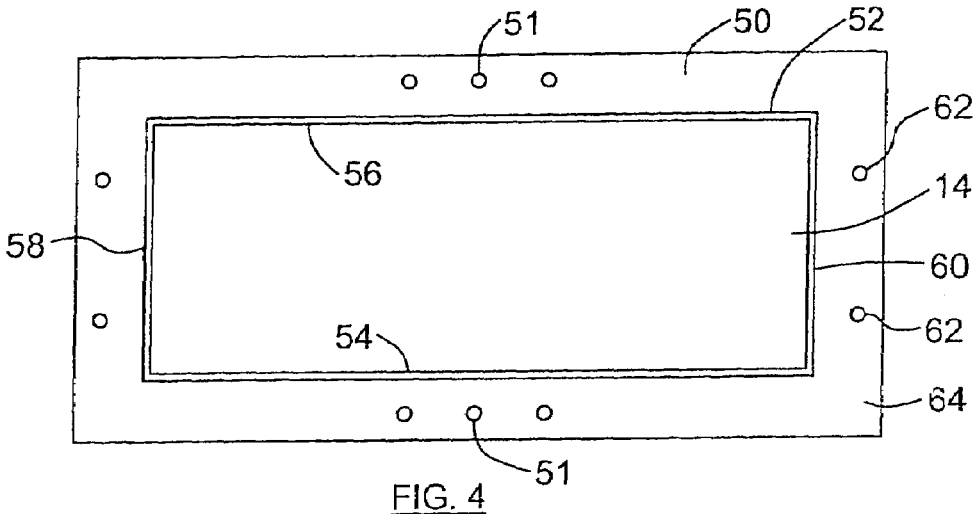
FIG. 4 is a top view of a metal tray that is a component of the candleholder of FIG. 1.
Figure 5:
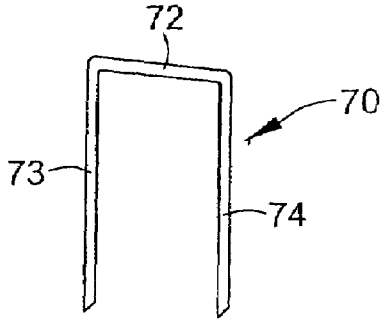
FIG. 5 is a perspective view of a two prong post or anchor for use with the candleholder.

Turning now to the construction of the tray or base unit 14 as illustrated, the tray provides a substantially flat bottom for the complete candleholder and the illustrated device comprises a rectangular metal sheet 50 which effectively forms the bottom of the candleholder and also a short, upstanding wall portion 52 which is connected to the top surface of the tray. The sheet 50 provides a horizontally extending support surface for a candle or candles. The preferred wall portion forms a complete, rectangular wall having two longitudinal wall sections 54 and 56 and two end wall sections 58 and 60. Thus, the wall portion 52 forms a completely surrounding enclosure which helps retain the candle or candles on the tray or base unit. Of course, it is also possible that the wall portion could comprise only a couple of wall sections, for example, only the two longitudinal wall sections 54 and 56 or it may comprise only short wall sections. A primary purpose of the wall portion 52 is to engage the sidewall portion 24 of the cover section during use of the candleholder and thereby act to hold the cover section on the tray. Thus, with the use of the wall portion 52, the cover section will not easily fall off of or slide off of the metal tray. The wall portion 52 can also act to catch candle drips or melted wax. The illustrated tray is formed with small attachment holes 62 and, as was the case with the cover section, these attachment holes can be arranged in pairs and they should be located so that they can be aligned with the holes 44 in the cover section. Holes 62 are formed in an outwardly projecting rim 64 that extends around the exterior of the wall portion 62. In one preferred embodiment, the width of the rim is uniform and is about 2 cm. The pairs of holes 62 can be used to secure the candleholder to the ground by means of securing devices that extend through the holes. One preferred form of securing device is the two prong anchor or ground post 70 illustrated in FIG. 5. The anchor 70 can be made from weather resistant wire having a thickness of 0.3 cm. For example, the anchor can be made from galvanized steel wire. The illustrated U-shaped anchor includes a cross-piece 72 and two downwardly extending prongs or legs 73, 74. The prongs can be pointed or sharpened at their bottom end, if desired. In one preferred version of the anchor, the legs are each 7 cm long while the cross-piece 72 has a length ranging between 4 and 5 cm. Of course, the length of the cross-piece should correspond to the distance between the holes of each pair of the holes 44, 62. The right side of FIG. 1 illustrates how one of the anchors 70 can extend through two holes in the flange 42 and also two holes in the rim 64. It is understood that four of the anchors 70 can be used to secure the candleholder 12 to the surface of the ground. Optionally, two or more screw holes 51 can be provided in the rim 64 to permit the metal tray to be secured by screws to an in-ground housing such as that shown in FIG. 17 and described hereinafter.

Although the illustrated tray 14 and cover section 12 are rectangular in plan view, it will be appreciated that they could equally be made square in plan view, if desired. It is also possible for this candleholder to be made of more expensive materials than those already indicated, particularly if the candleholder is intended for long term use. For example, the tray and the cover section can both be made of bronze or die-cast aluminum or die-cast aluminum alloy.

It will be understood that the preferred ventilation openings 34 should be positioned a sufficient distance above the bottom or above the tray of the candleholder so that the candle flame can be readily seen through one or more of the openings during use of the candleholder. It is preferred that the openings be located at a height corresponding approximately to the height of the candle or candles to be used. In a particular preferred embodiment, the bottom end of the openings 34 is at least 3 cm above the flange 42. It will be understood that a preferred height of the wall portion 52 of the tray is about 2 cm and thus it is preferred that the bottom ends of the openings 34 be located at least slightly above the top of the wall portion 52 of the tray. This is illustrated in FIG. 1 by the dashed line at 76 which indicates the top of the wall portion 52.

An optional feature of the illustrated candleholder 10 is the use of decorations which can be provided on the top 20 of the cover section. For example, the top can be decorated with a heart or cross design and/or with suitable word messages such as "I love you" or "God Bless". Fine cuts can also be formed in the top, if desired, and these cuts can add to the decoration and can in addition allow candle smoke to escape from the cover section. The holes or cuts in the top of the cover section should normally be quite small and appropriately positioned so as not to allow any significant amount of rain into the candleholder, which might otherwise extinguish the candle or candles.

One preferred embodiment of the candleholder 10 has a cover section or cover member with the top having a length of 20 cm and a width of 8 cm. The depth of the cover section measures 10 cm. The tray or base unit used with this cover section has an overall length of 23 cm and a width of 11 cm while the length of the wall portion 52 is 19 cm and its width is 7.5 cm. Of course, the dimensions of the cover section and the tray can vary from these particular dimensions.

Figure 7:
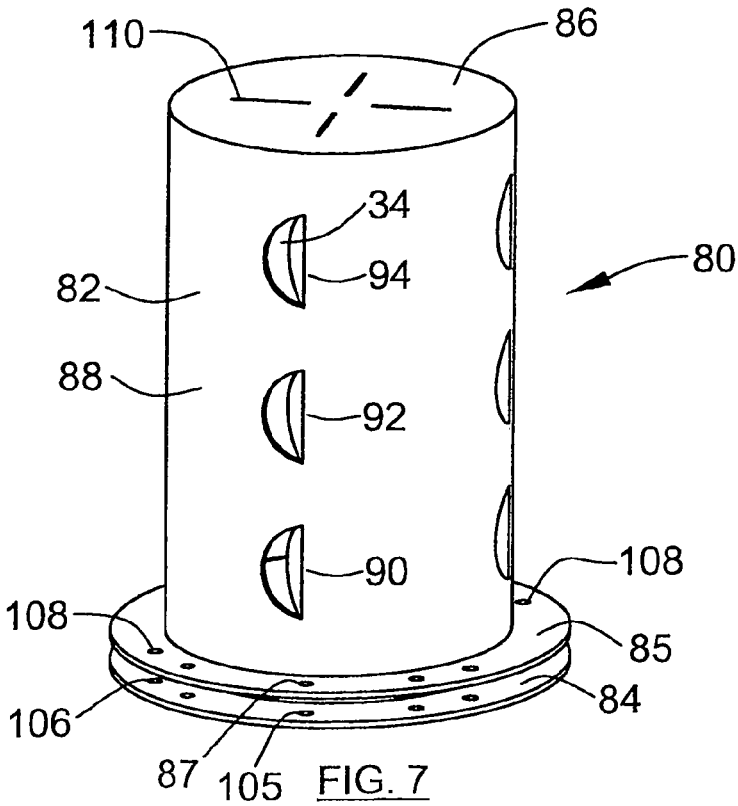
FIG. 7 is a perspective view of a second embodiment of candleholder, this embodiment having a cylindrical cover section.
Figure 8:
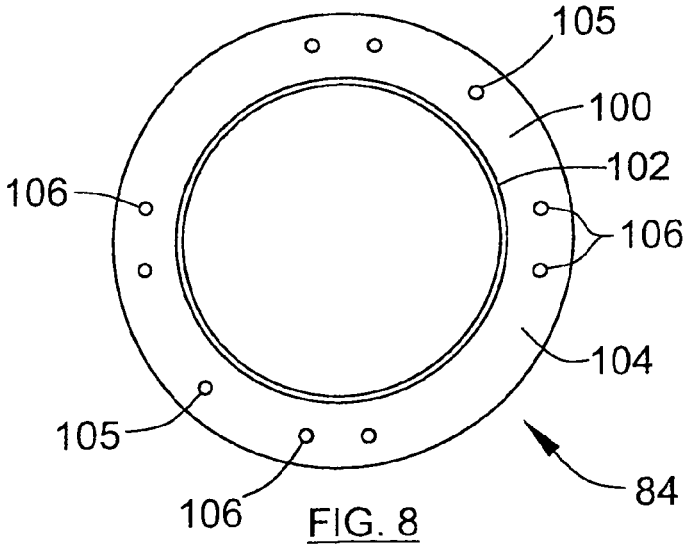
FIG. 8 is a top view of a round tray for use with the cover section shown in FIG. 7.
Figure 9:
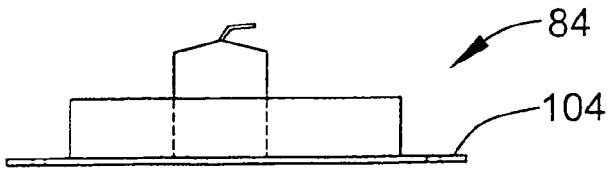
FIG. 9 is a side view of the tray of FIG. 8, this view showing a short candle placed on the tray.

Turning now to a second embodiment of candleholder which is illustrated in FIG. 7 to 9, this candleholder 80 is similar to the candleholder 10 already described, except for the differences noted hereinafter. The candleholder 80 also includes a metal cover section 82 and a metal tray or base unit 84 for holding a candle or candles. The cover section or cover member includes a circular, closed top 86, an open bottom and a peripherally extending cylindrical sidewall portion 88 that extends downwardly from and is joined to the top 86. Again, the sidewall portion 88 is formed with a plurality of crescent-shaped openings 34 that are formed in the same manner as the openings 34 shown in FIGS. 1 and 3. However, because of the preferred height of this particular candleholder, the openings 34 are arranged one above the other at three levels indicated at 90, 92 and 94 and the openings are also distributed about the circumference of the cylindrical sidewall. The cover section also has an annular bottom flange 85 that projects outwardly.

The tray portion is formed from a flat circular metal sheet 100 which, in one embodiment, has a diameter of 14 cm. Extending upwardly from this sheet is a short, upstanding wall portion 102 that forms a short cylinder. The tray 84 has an outwardly projecting rim 104 which can have a uniform width of 2 cm and which can be formed with pairs of attachment holes 106. It will be seen that the bottom of the cover section is also provided with attachment holes 108 which can be aligned with the holes 106. Again, it will be appreciated that the dimensions of the tray 84 and the cover section can vary from those indicated both in height and width. The rim 104 can optionally be provided with two or more screw holes 105 for use in securing the tray to an in-ground housing as described hereinafter (in conjunction with FIGS. 16 and 17). Similarly the flange 85 of the cover section can be provided with two or more screw holes 87 for use in securing this cover section to this in-ground housing described below (in conjunction with FIGS. 16 and 17).

In one preferred embodiment of the candleholder 80, the height of the cover member is about 17 cm and the diameter is 10.5 cm. There can also be a smaller version of the candleholder wherein the height is 10 cm and the diameter 6.5 cm. Although the illustrated candleholder of FIG. 7 is not decorated, if desired, the top 86 can be decorated by either decorative imprints or painting and, as with the previous embodiment, cuts indicated at 110 can be formed in the top both for decorative purposes and to allow candle smoke out. The candleholder 80 can be made of the same types of materials as indicated for the candleholder 10. Because of the smaller size of the base of the candleholder and the fact that the rim 104 of the tray and the flange on the bottom of the cover section are annular, the two prong anchors used to secure the candleholder 80 to the ground can be made narrower in width and may, for example, only have a width of 2 cm for a small version of the candleholder 80.

Figure 10:
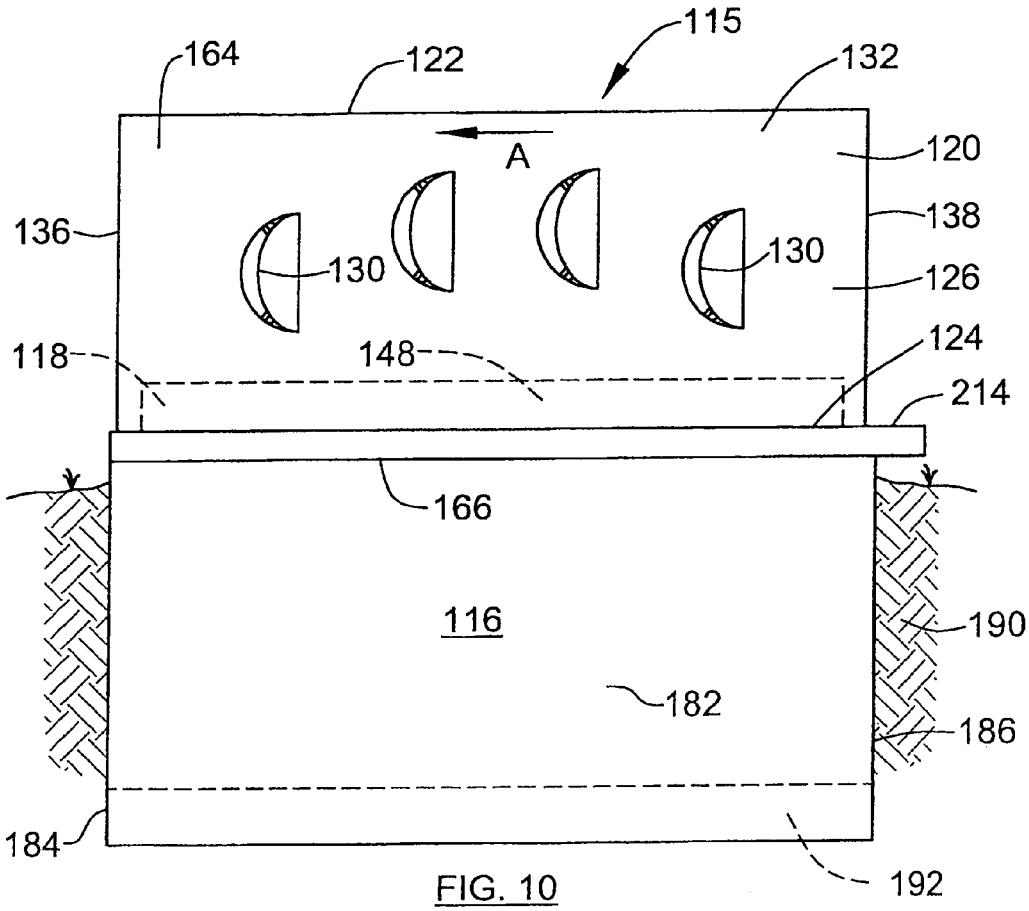
FIG. 10 is a side view of a third version of candleholder apparatus, this version adapted for mounting in the ground.
Figure 11:
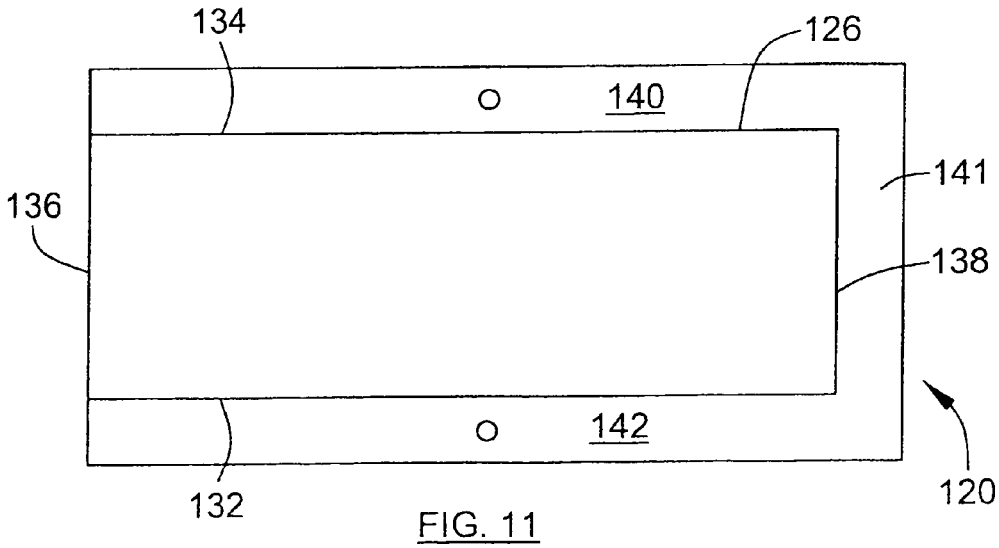
FIG. 11 is a plan view of the cover section for the embodiment of FIG. 10.

A third embodiment of candleholder apparatus is illustrated by FIGS. 10 to 13 and is indicated generally at 115. This apparatus 115 is particularly suitable for use outdoors as it includes an exterior housing 116 adapted for mounting in the ground below ground level. Other major components of this candleholder apparatus include a tray section 118 illustrated in FIG. 12 and a separate cover section 120 shown in FIGS. 10, 11, 13A and 13B. The cover section 120 will first be described as it is similar in most respects to the cover section 12 of FIG. 1. Again, the cover section 120 is intended for placement over one or more candles and on the tray section 118. The preferred cover section has a closed top 122, which as illustrated is rectangular, an open bottom at 124, and a peripherally extending sidewall 126 that extends between the top and the bottom of the cover section. As in the first embodiment, the cover section is formed with crescent-shaped openings 130 which can be identical in their construction and shape as the openings 34. As illustrated in FIG. 10, there are four of these openings 130 distributed across each of the longitudinal vertical walls 132, 134.

Figure 13A:
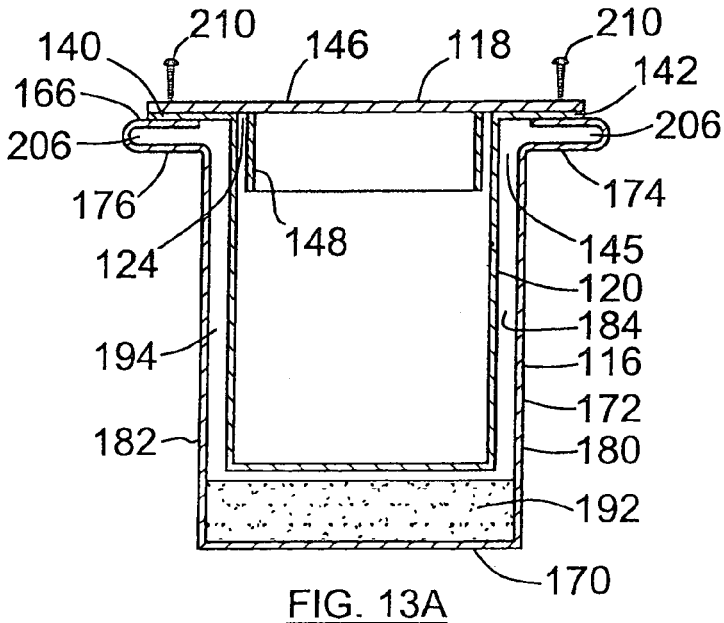
FIG. 13A is a vertical cross-section of the candleholder apparatus of FIG. 10, this view showing the cover section placed in the housing for storage.
Figure 13B:
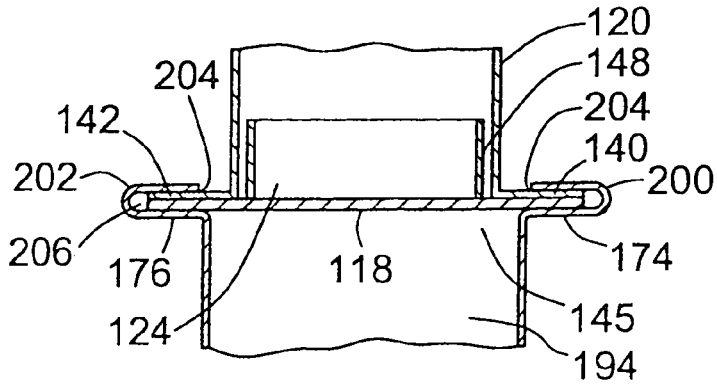
FIG. 13B is a partial vertical cross-section of the candleholder apparatus, this view showing the cover section and tray in their upright, candle holding position.

Joining the longitudinal walls is one end wall 138. The end wall 138 can also be formed with openings 130, if desired. The cover section 120 is preferably formed with three outwardly extending flanges 140 to 142 at the bottom thereof and these can be integrally connected together as shown to form a single peripheral flange. It will be understood, however, that it is not necessary for flanges to be formed on three sides of the bottom of the cover section. For example, there could be simply two flanges on opposite sides of the cover section such as the flanges 140, 142. These flanges are used to mount the cover section both in the upright position as illustrated in FIGS. 10 and 13B and in an upside down position as illustrated in FIG. 13A. As the candleholder 115 is intended for long term use and not for use only once or a few times, its major components, including the cover section, are normally made from stronger, more durable materials such as bronze or die-cast aluminum.

In one particular embodiment of the cover section, the top 120 has a length of 22.5 cm and a width of 8 cm and the depth of the cover section is approximately 10 cm. The width of the flanges 140 to 142 can be a uniform 2 cm. Also, although the illustrated preferred cover section has an open end at 136, the purpose of which is explained below, it is also possible for this end of the cover section to have an end wall, although this will affect the manner in which the cover section is mounted in place on the tray section 118.

Figure 12:
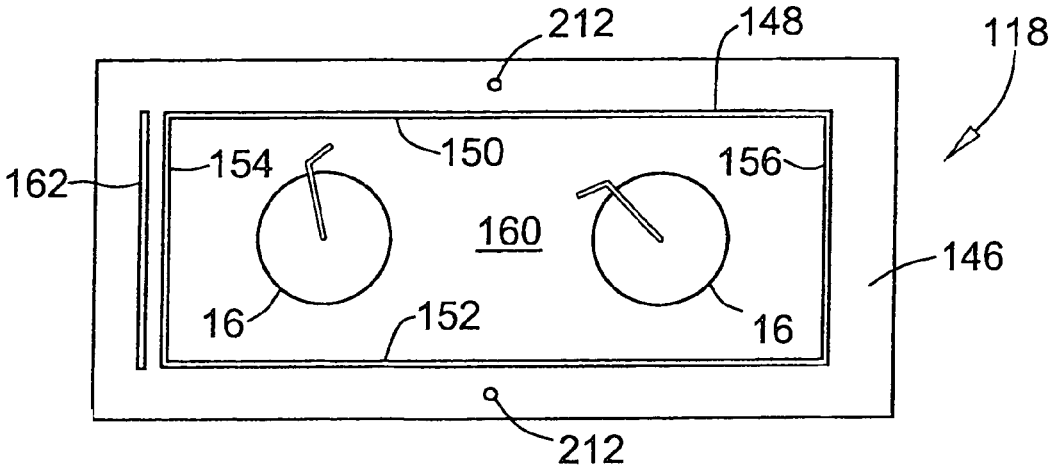
FIG. 12 is a top view of a tray suitable for use with the cover section of FIG. 11.

Turning now to the construction of the preferred tray section illustrated in FIG. 12, it should first be understood that the tray section 118 is preferably sized for and adapted for use not only to support the cover section on top of the housing as illustrated in FIG. 10, but also for use as a top cover when the cover section 120 is stored in the housing as shown in FIG. 13A. The preferred tray section 118 is capable of completely covering the rectangular opening 145 formed in the top of the housing 116 as well as capable of covering the bottom of the cover section. As illustrated, the tray section includes a flat, rectangular metal plate 146 and a wall portion 148 which extends upwardly when the tray section is in its upright, horizontal position and which is connected to the metal plate 146. The preferred, illustrated wall portion 148 forms a continuous, short, rectangular wall including two longitudinal wall sections 150, 152 and two, shorter end wall sections 154, 156. The uniform height of the wall portion 148 can be 2 cm and it will be understood that the dimensions of the wall portion 148 are selected so that the wall portion will fit within the opening in the bottom of the cover section. In one preferred embodiment of the tray section, the length of the metal plate 146 is 24.5 cm and the width is 12 cm and the thickness of the plate is 0.3 cm. Also, in this embodiment, the wall sections 150, 152 have a length of 18 cm while the length of the wall sections 154, 156 is 7.8 cm. It will be understood that the tray section 118 has an upright, horizontal position indicated in dashed lines in FIG. 10 which is used for supporting two or three small round slow burning candles 16, or possibly a rectangular block candle (not shown). These candles are supported on an upwardly facing first side 160 of the tray section. Note that the tray section has two distinct uses. For the second use, the tray section is placed in an upside down, horizontal position for covering the opening in the housing when it is being used to store the rest of the candle holder apparatus. Again, this upside down position for the tray section is illustrated in FIG. 13A.

The preferred tray section also has an upstanding wall section 162 which is connected at its bottom edge to the metal plate 146. The purpose of the wall section 162 is to close the cover section 120 at its end 136 when the cover section is either placed on or moved onto the tray section. Thus, the wall section 162 is preferably sized at least to cover the end 136 of the cover section and it can be sized, if desired, to fit snuggly within an end section 164 of the cover section. In one embodiment of this tray section, the wall section 162 has a width slightly less than 8 cm and a height of about 9 cm. As will be seen, by using an open ended cover section and by using the wall section 162 on the tray section, it is possible to slide the cover section 120 in a horizontal direction over the tray section, the cover section being slid in the direction of the arrow A in FIG. 10.

Turning now to the preferred construction of the exterior housing 116, the illustrated housing is box-like and has a rectangular top 166 with the relatively large opening 145 formed therein. The preferred housing can have a closed metal bottom at 170 and a peripherally-extending sidewall portion 172 extending between the top and the bottom. It will be understood that the cover section 120 can be inserted substantially through the opening 145 in the top of the housing for storage (as illustrated in FIG. 13A). In the illustrated preferred version of the candleholder apparatus, the cover section is inserted upside down through the opening 145 and its flanges 140, 142 rest on the top 166 of the housing.

The sidewall portion 172 as illustrated includes two longitudinal wall sections, 180, 182, and two end walls sections, 184, 186. These wall sections must be made sufficiently strong to withstand the pressure of the surrounding ground 190. Preferably, the housing has a base portion 192 made of concrete and forming a bottom section of the housing. The layer of concrete can, for example, be 3 cm thick and the weight of the concrete helps to hold the entire candleholder apparatus at the selected level in the ground. If the housing is provided with the aforementioned metal bottom 170, then cement can simply be poured into the open top of the housing and then leveled and allowed to set to form the desired concrete layer. Of course, a sufficiently high space 194 must be left above the concrete layer to accommodate the cover section 120. It is also possible to construct the housing so that its base or bottom is formed by the layer of concrete 192 and there is no metal bottom 170. In this case, the bottom section of the sidewalls and end walls are connected directly to the concrete layer 192.

FIGS. 13A and 13B illustrate how the tray section 118 and the cover section 120 are arranged on top of the housing both for use of the candleholder apparatus with one or more candles and also when the candle holder apparatus is not in use and is in a storage mode, the latter being shown in FIG. 13A. The preferred housing 116 is formed with two folded back lip portions 200 and 202. These lip portions extend along the long, top edges of the housing and they can be integrally formed by a metal folding process at the top of the longitudinally extending sidewalls. The folded lip portions form an elongate slot which is open on the inside at 204. The elongate slots 206 have a sufficient height to accommodate both a respective one of the flanges 140, 142 on the cover section and an edge section of the metal plate 146 of the tray section 118. In the upside down or storage position shown in FIG. 13A, the opposing flanges 140, 142 of the cover section rest on top of respective lip portions 202, 200. Similarly, opposite edge sections of the metal plate 146 rest on top of the inverted flanges 140, 142 as shown. Thus, the opening in the top of the housing and the opening in the cover section are completely covered by the tray section 118. In order to secure the tray section in this position, two or more screws 210 can be used, these screws extending through aligned holes formed in the plate 146, the adjacent flanges of the cover section and in the lip portions 200, 202. Two of these screw holes are illustrated at 212 in FIG. 12.

FIG. 13B illustrates the arrangement when the cover section 120 is in the upright position, that is the position used for holding lit candles. In this position, the base section 118 is also in the upright position with the wall portion 148 extending upwardly. Opposite longitudinal edge sections of the tray section are slid into the slots 206 as shown, these edge sections resting on the outwardly extending flanges 174, 176. It will be understood that the tray section can be slid into these slots from one end thereof, for example, the end indicated at 214 in FIG. 10. After the tray section has been mounted on top of the housing and the candles have been placed in position on the tray section and lit, the cover section can then be slid into the two slots 206 over top of the tray section as shown. Thus, the opposite flanges 140, 142 are also accommodated within the slots and are held therein. If desired, an outwardly extending flange can also be provided at one or both ends of the housing in horizontal alignment with the flanges 174, 176. It will be understood, however, that there is no folded back lip portion formed at the top of the housing ends.

Figure 14:
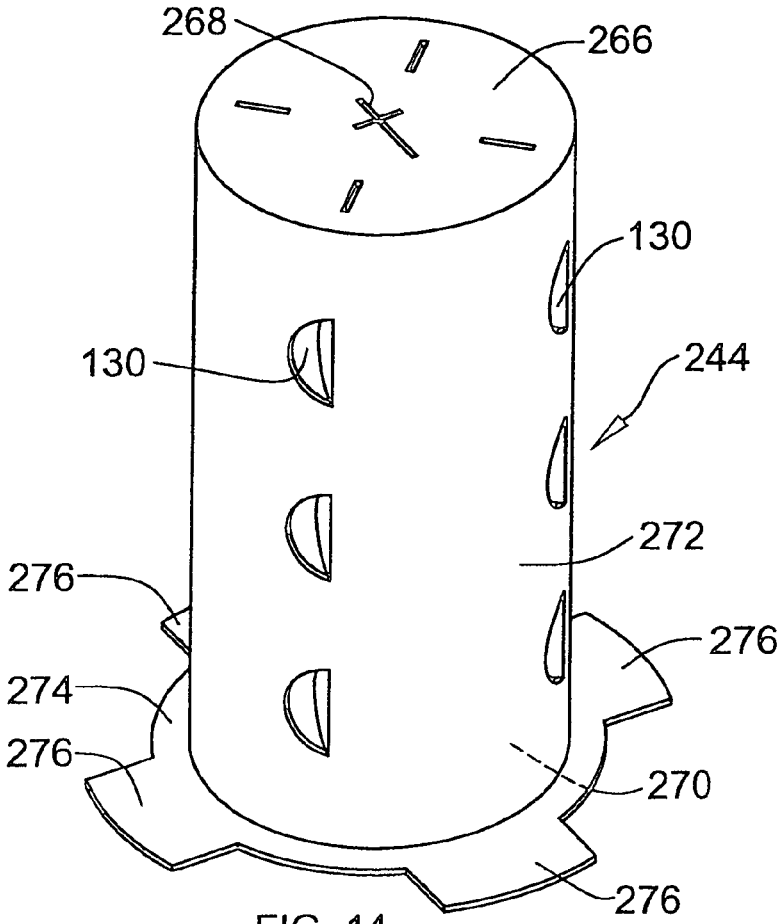
FIG. 14 is a perspective view of the cover section for a fourth embodiment of candleholder.
Figure 15:
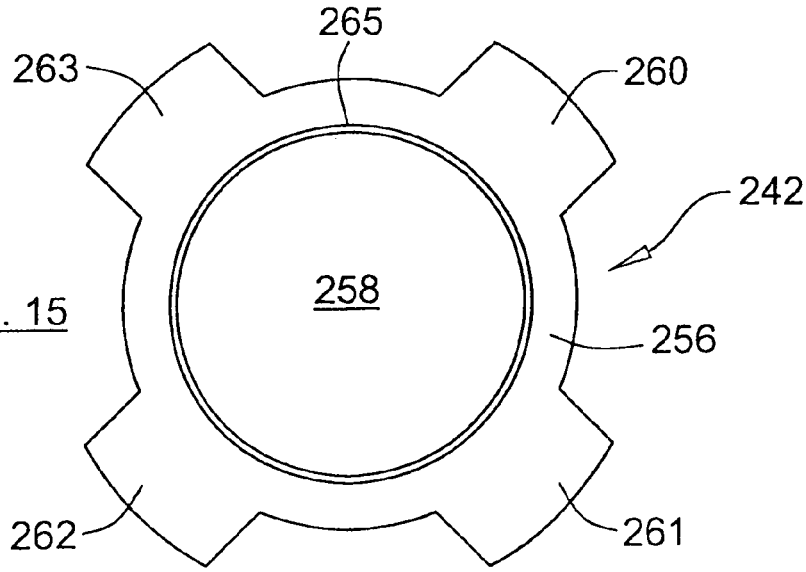
FIG. 15 is a plan view of a tray usable with the cover section of FIG. 14.
Figure 16:
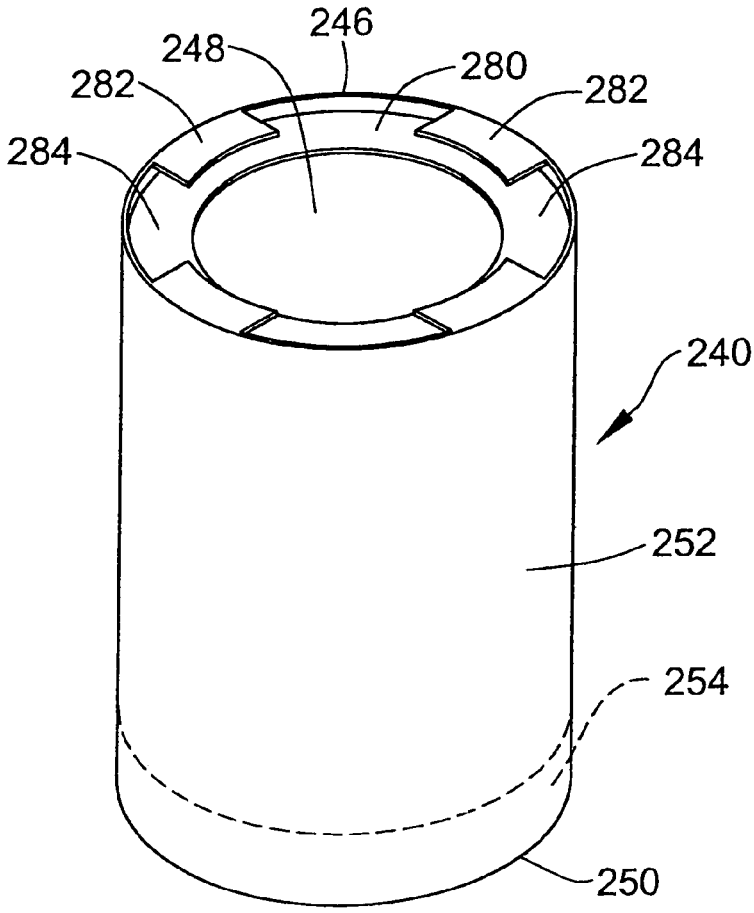
FIG. 16 is a perspective view of a cylindrical housing that can be used with the cover section and tray of FIGS. 14 and 15.

Turning now to the embodiment illustrated in FIGS. 14 to 16, this embodiment is somewhat similar in its construction and use as that illustrated in FIGS. 10 to 13B. This candleholder apparatus also includes an exterior housing 240 illustrated in FIG. 16 which is adapted for mounting in the ground below ground level, a tray section 242 illustrated in FIG. 15 and a separate cover section for placement over a candle and on the tray section, this cover section 244 being illustrated in FIG. 14. The housing 240 has a round top at 246 with a relatively large opening 248 formed therein. It will be understood that the opening 248, which is circular, is large enough to permit the cover section 244 to be slid into the opening upside down so that it can be stored in the housing. The housing further includes a bottom 250 and a peripherally extending sidewall portion 252 which in this embodiment is cylindrical. The sidewall portion extends between the top 246 and the bottom 250. As in the previous embodiment, the exterior housing preferably has a base portion indicated at 254 which is made of a layer of concrete. The layer of concrete gives the housing sufficient weight that it will normally remain in position when buried in the ground with the top 246 at ground level. The tray section 242 includes a substantially round metal plate which normally extends horizontally. As was the case with the tray section 118, the tray section 242 can be used either in an upright horizontal position for supporting a candle on an upwardly facing first side 258 and also an upside down horizontal position for covering the opening on top of the housing and also for covering the stored cover section. The preferred tray section 242 is formed with a plurality of radially outwardly extending, spaced apart ears 260 to 263. The ears can be integral extensions of the plate 256 and each ear can be arranged at 90 degrees to adjacent ears in the version having four ears, as illustrated. The ears are formed with rounded outer ends as shown. These ears can be used both to secure the tray section in its upright horizontal position and in its upside down horizontal position as explained further hereinafter. As with the previous tray sections, the tray section 242 is formed with a short wall portion 265. The illustrated wall portion is cylindrical but it is also possible that the wall portion could comprise two or more wall sections having an arcuate shape as seen in plan view. In one preferred embodiment, the height of the wall portion 265 is 2 cm and it has a diameter of about 8 cm. It will be understood that the external diameter of the wall portion 265 should be slightly less than the internal diameter of the cover section 244.

The preferred cover section 244 has a circular, closed top 266 which may have a decorative design, such as the cross 268 formed or painted thereon. The cover section also has an open bottom at 270 and a periphery extending sidewall 272 which in this embodiment is cylindrical. Again, the cover section 244 has a number of crescent-shaped openings 130 formed therein in the manner already described above. These openings permit combustion air to flow into the cylindrical cavity formed by the cover section and, at the same time, because of the manner in which they are formed, protection is provided from the wind. Also, the cover section is formed with an annular, outwardly extending flange 274 at its bottom end and extending outwardly from this flange are four ear connectors 276. Preferably, the number of ear connectors 276 corresponds to the number of ears formed on the tray portion and they are alignable with these ears. The length of each ear can be 2 cm in one embodiment and the width can be about 4.3 cm. In this embodiment, the height of the cylindrical wall portion 272 is 17 cm and this embodiment is able to accommodate a taller candle, for example, a candle having a height of about 7.5 cm and a diameter of 7 cm. It should be noted here that all of the candles used in these candleholders should be slow-burning candles so that they will be efficient and long lasting.

Because of the height of the cover section in this embodiment, it can be provided with openings 130 at three different levels as illustrated in FIG. 14.

The upper section of the housing 240 is unique and is adapted to permit attachable connection of both the cover section and the tray section. In particular, it will be seen that a short distance down from the top edge of the housing is an internal flange 280 which defines the aforementioned opening 248. Extending inwardly from the top edge of the housing are four tabs or locking clips 282. It will be understood that the bottom surface of these tabs is spaced a predetermined distance above the flange 280. As will be understood, this distance must be sufficient to accommodate both the thickness of the ears 260 to 263 and the ear connectors 276. Located between the tabs 282 are four arc-shaped gaps 284 and through these gaps first the ear connectors 276 can be inserted and then, after the cover section 244 has been fully inserted into the housing, the ears 260 to 263 can be inserted through these gaps. It will be understood that, as with the previous embodiment, the cover section 244 can be stored in the housing by inserting the cover section in an upside down position through the hole 248 and then the ear connectors 276 will rest on top of the flange 280. If desired, the cover section can then be rotated so that the ear connectors 276 are underneath the tabs 282. The next step is then to use the tray section 242 as a cover for the top of the housing and it will be understood that the tray section 242 is sized for and adapted for use as a top cover. When Used in this manner, the tray section is placed in an upside down position so that the wall portion 265 extends downwardly. In this position, the ears 260 to 263 are aligned with the gaps 284 and then dropped through these gaps, leaving the tray section resting on top of the inverted cover section. The user can then rotate the tray section in order to place the ears 260 to 263 underneath corresponding tabs 282.

In order to use the candleholder of FIGS. 14 to 16 to support at least one candle, the stored cover section 244 and the tray section are removed from the top of the housing 240. The tray section 242 can then be placed in the upright position on top of the housing with the ears 260 to 263 again aligned with the gaps 284. The tray section is then dropped onto the top of the housing so that the ears rest on top of the annular flange 280. Once the tray section is positioned, the cover section 244 can then be mounted on top of the housing and on top of the tray section. Again, the ear connectors 276 would be aligned with the gaps 284 and then moved downwardly through these gaps until the bottom of the cover section rests on the tray section 242. Then, in order to secure the cover section 244 in the upright position, it can be rotated 45 degrees to place the ear connectors 276 beneath respective tabs 282. In this position, the cover section is reasonably secure and cannot easily be tipped over.

Note that when the housing 240 is being used for storage, it is also possible to store a left over candle or a new candle in the upside down cover section, if desired. Another optional feature of this candle holder is that the bottom of the tray section 242 can have a decorative design thereon, if desired. This decorative design will be visible, of course, when the tray section is in the upside down position which is used during its storage mode.

Figure 17:
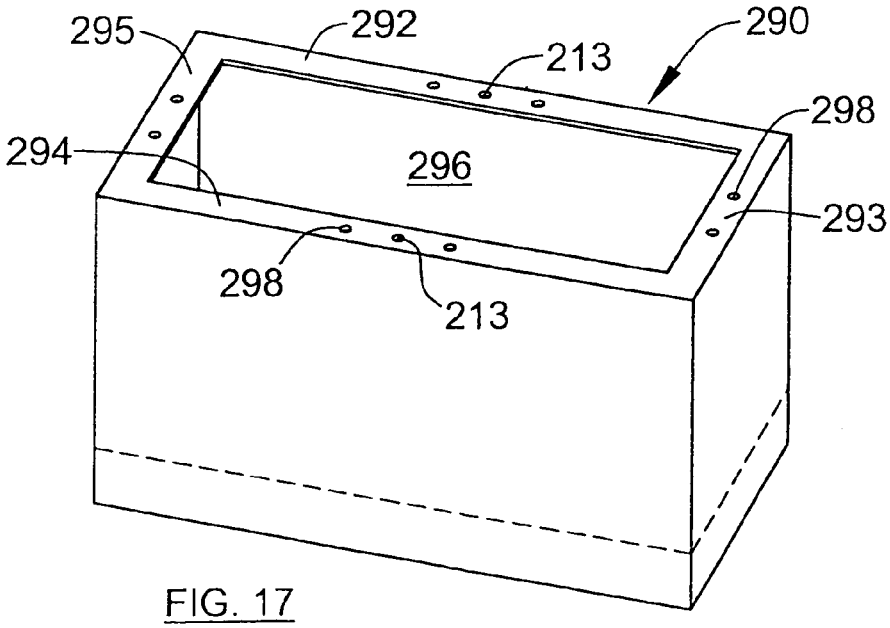
FIG. 17 is a perspective view of an alternate form of housing that can be used with a rectangular cover section and tray.

FIG. 17 illustrates an alternate form of rectangular exterior housing. This exterior housing is indicated generally by 290. It will be understood that the housing 290 is constructed in a manner similar to the housing 116 of FIG. 10, except for the differences noted herein. The primary difference in this housing is the formation of the top section of the housing. In particular, instead of having an outwardly extending flange or a folded over lip, there is an inwardly extending flange extending about the periphery of the housing at the top of its four walls. In particular, there are four flanges or flange sections 292 to 295. The inner edges of these flanges define a rectangular opening 296 through which a cover section similar to the cover section 120 can be inserted in an upside down position. Also formed in the flanges are a number of attachment holes 298 which, in a preferred embodiment, can be arranged in pairs. These holes can be used to attach a tray section similar to the tray 14 of FIG. 4 to the top of the housing, either in an upright position or in an inverted position. Suitable fasteners can be extended through both the attachment holes 62 in the tray section and through the holes 298 in the top of the housing in order to attach the tray to the housing. These fasteners can, for example, be in the form of the U-shaped anchors or posts described above (and illustrated in FIG. 5). An optional additional feature is the use of one or two screw holes 213 which can be located centrally along the length of the top of the housing. These permit one or two screws to be used to securely attach the tray to the top of the housing. Corresponding, aligned screw holes are of course provided in the tray.

It will be understood that the housing 290 is designed for burial in the ground with the top of the housing at ground level. In one preferred embodiment of the housing of FIG. 17, the length of the housing is 23 cm and the width is 11.5 cm. The inwardly extending flanges have a width of 1.5 cm.

It will also be understood that it is possible to form a cylindrical housing in a manner similar to the rectangular housing 290. Again, the cylindrical housing would have a circular opening in its top, this opening being defined by an inwardly extending, annular flange in which attachment holes are formed. Such a housing can be used to either mount or store a cylindrical cover section fitted with a circular tray (already described above). A couple of screw holes can also be provided in the annular flange of this housing on opposite sides thereof to allow the use of two screws to securely attach the tray to the top of the housing.

Figure 18:
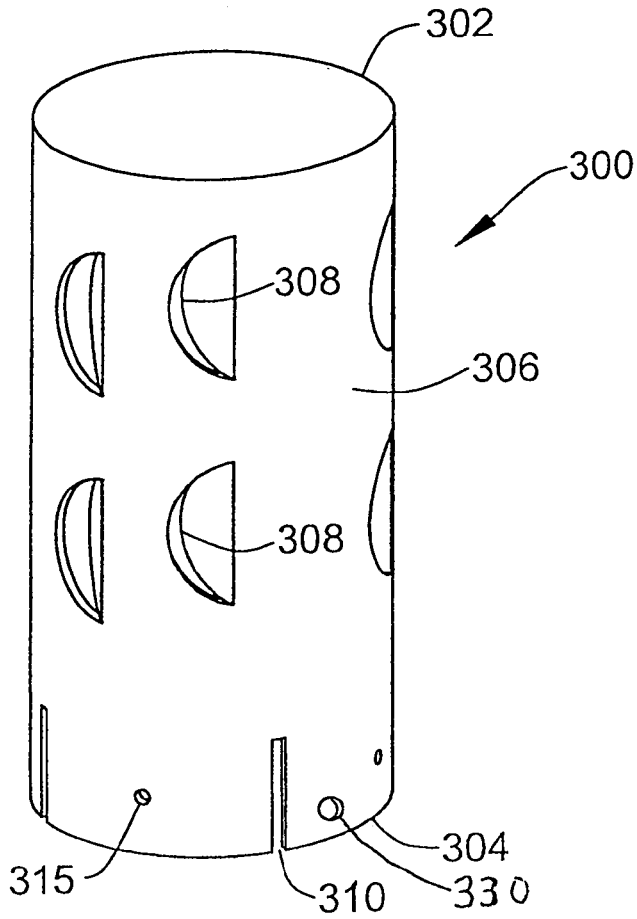
FIG. 18 is a perspective view of yet another embodiment of cover section for a candleholder.
Figure 19:
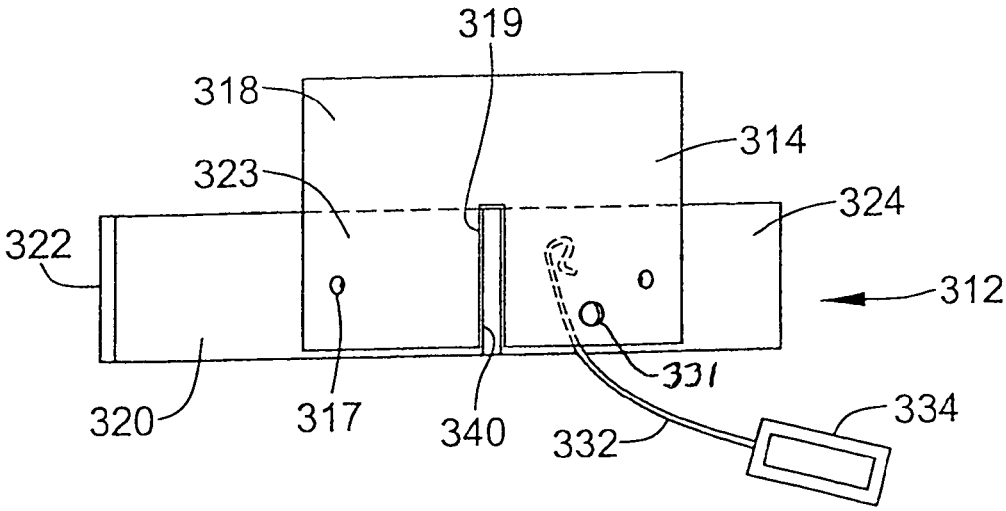
FIG. 19 is a side view of a support device including a tray for the cover section of FIG. 18.
Figure 20:
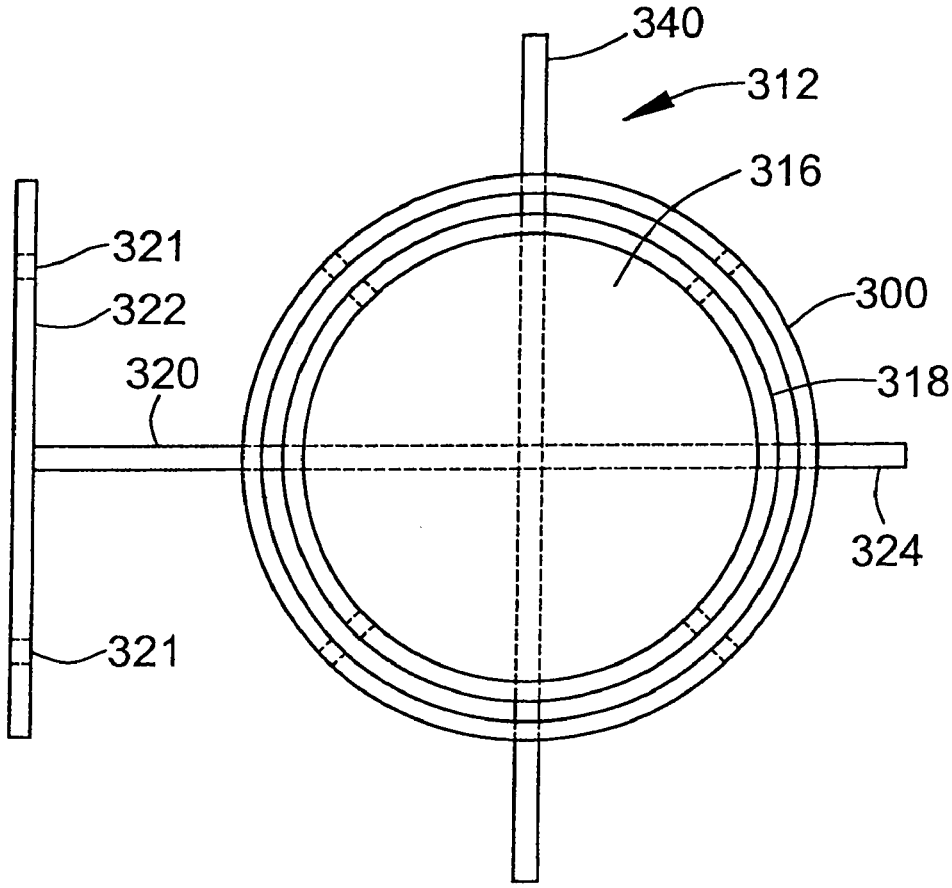
FIG. 20 is a top view of the support device of FIG. 19 with the cover section mounted thereon, the top of the cover being omitted for sake of illustration.

Yet another embodiment of candleholder is illustrated by FIGS. 18 to 20 of the drawings. This cylindrical candleholder includes a separate, metal cover section 300 which has a closed top 302 and an open bottom at 304. If the candleholder is to be used indoors, the top 302 need not be entirely closed but can have an opening therein to allow smoke out. It should be understood that this candleholder is particularly designed for use indoors such as in a mausoleum or in an underground burial site. As this candleholder is designed for long term use, it can be made from bronze or aluminum die cast. In one preferred embodiment, the cover section has an overall height of 12 cm and a diameter of 6 cm and it is formed with a number of crescent-shaped openings 308 which can be similar in their construction to the ventilation openings 34 of the first embodiment. The illustrated openings 308 are arranged in two or more rows, one above the other. The openings are distributed about a cylindrical sidewall portion 306 that extends from the top 302 to the bottom 304. Unlike the previous cylindrical cover sections, the cover section 300 has no outwardly extending bottom flange but instead is formed with four vertically extending slots 310 which extend upwardly from the bottom end of the cover section. In one preferred embodiment, the slots have a length of 2 cm and they are evenly distributed about the circumference of the sidewall portion 306.

Figure 21:
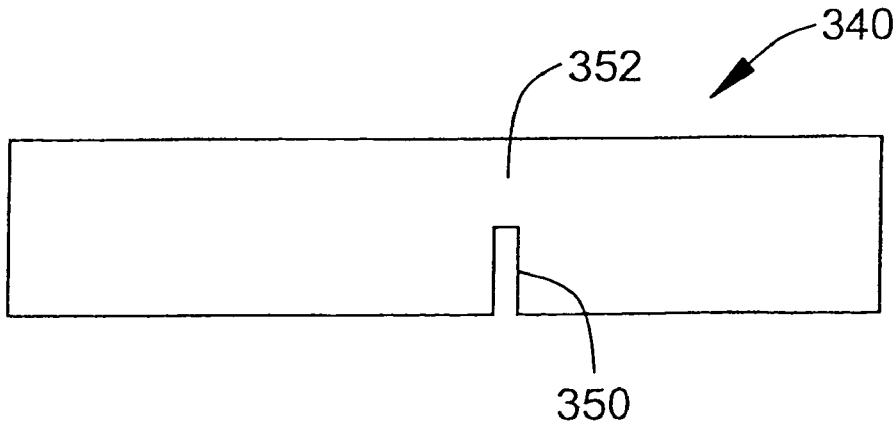
FIG. 21 is a side elevation of a cross-piece that can be used in the support device of FIG. 19.

Another component of this candleholder is a stand section indicated generally at 312 which can be used to mount the candleholder on a wall, of example. The stand section includes a metal tray or bottom cylinder 314 which can have an external diameter of 5.75 cm slightly less than the internal diameter of the cover section 300. As with the previous embodiments, this tray is used to hold a candle and it provides a substantially flat bottom for the candleholder, this bottom being indicated at 316. The tray has a relatively short upstanding wall portion 318 which is connected to and extends upwardly from the flat bottom of the tray. In one embodiment, the height of this wall portion is 2.5 cm. A bottom section of the tray 314 has four slots 319 that extend upwardly from a bottom edge and that are evenly distributed about its circumference. In a preferred version, theses slots are 2 cm long. The tray 314 is mounted on top of a support arm or bracket 320 which extends from wall anchor 322. It will be understood that the wall anchor can either be embedded in the wall or attached thereto by fasteners such as bolts or screws (not shown) extending through screw holes at 321. The arm 320 has a projecting end section at 324. The upper edge of the arm is inserted into two opposing slots 319 formed in the tray and thus the tray is detachably connected to the arm 320 prior to placement of the cover section over the tray. It will be understood that the section of the arm 320 between the wall anchor at 322 and the tray then slides into one of the slots 310 and the projecting end section 324 slides into an opposite slot 310 formed in the cover section 300. In this way the cover section 300 is fully supported and surrounds the tray 314. A relatively tall, single, slow burning candle can be placed on the tray, for example, a candle having a height of 6 cm and a diameter of 4.5 cm. Also, in order to provide rigidity and strength to the connection between the arm 320 and the tray 314, a cross-piece 340 can extend in a perpendicular manner from opposite sides of the arm 320 immediately below the tray. The cross-piece can extend into two slots 319 formed on opposite sides of the bottom section 323 in order to support the tray. As shown in FIG. 21, the cross-piece 340 can be formed with a slot 350 that extends upwardly from its bottom edge. The arm 320 can be inserted into this slot in order to connect the cross-piece to the arm. If desired, another slot (not shown) can be formed in the arm 320, this slot extending downwardly from the top edge of the arm.

This slot can for example be 1 cm long if the arm has a depth of 2 cm. The bridge section 352 of the cross-piece will then fit into this slot in the arm, thereby making the upper edge of the arm level with the top edge of the cross-piece. Alternatively, the cross-piece can be permanently attached to the arm by welding or by integral connection. In the alternative, screw holes can be provided to secure the arm 320 to the tray 314 by means of two or more screws and suitable connecting brackets (not shown).

An optional additional feature is the use of screws to more securely attach the cover section 300 to the metal tray 314. In order to provide this feature two to four screw holes 315 can be provided between the slots 310 and near the bottom end. Also, additional screw holes 317 are provided in the tray near its bottom end, the holes being located so that they will align with the holes 317 when the cover section is placed over the tray.

Optional additional features illustrated in FIGS. 18 and 19 include a fastening hole 330 formed near the bottom end of the cover section and a securing chain 332 attached at one end to the inside of the bottom section 323 of the tray (as shown) or to the arm 320. Attached to the outer end of the chain is a suitable latch or fastener 334 which can be of known construction. The latch or fastener can extend through the hole 330 in the cover section and an aligned hole 331 formed in the base section in order to securely connect the cover section to the base section of the candleholder.

Figure 22:
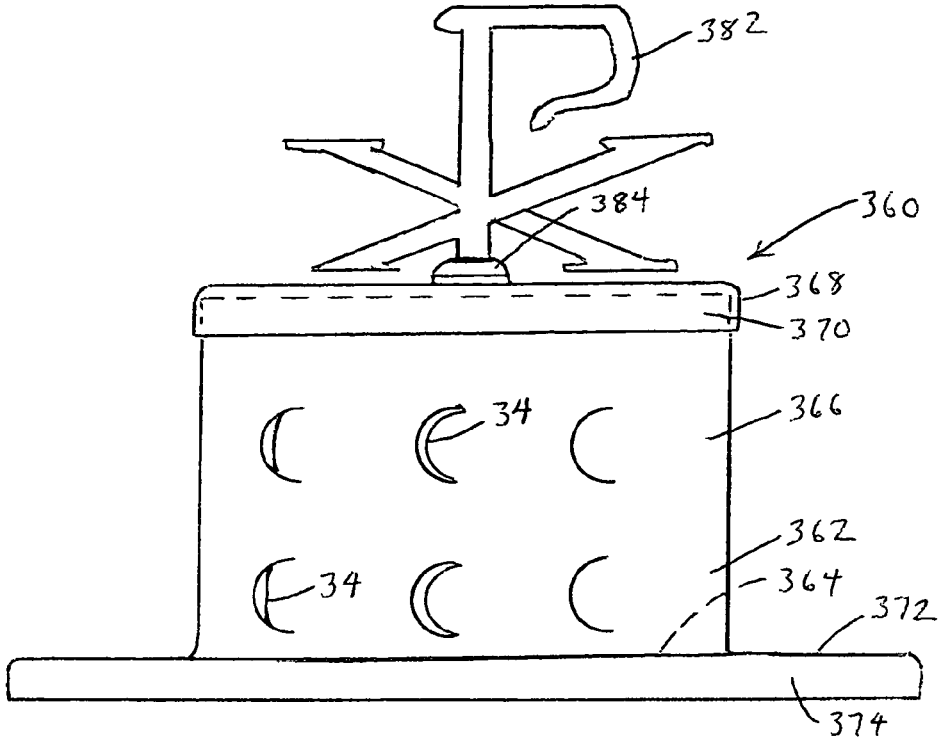
FIG. 22 is a side elevation of a further embodiment of a candleholder which is portable.
Figure 23:
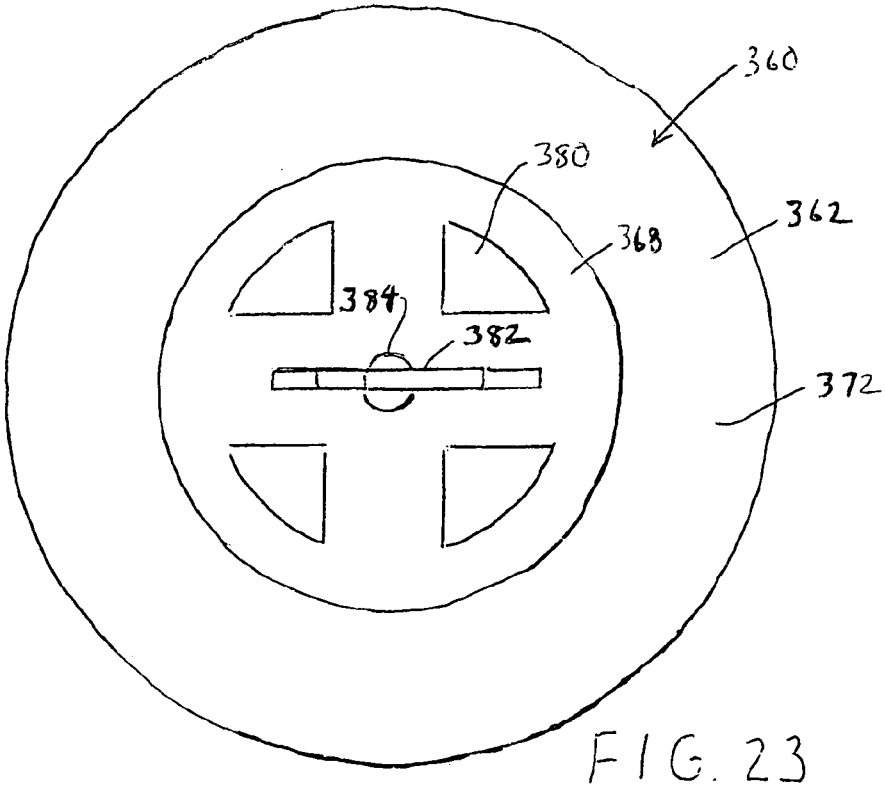
FIG. 23 is a top view of the candleholder of FIG. 22.

FIGS. 22 and 23 illustrate an additional form of portable candleholder, this candleholder being indicated generally at 360. The candleholder, which can be made inexpensively so that it is disposable after use (if desired), has a base unit 362 for holding a candle, this base unit providing a horizontally extending support surface located at 364 for a candle and has an upstanding wall portion 366 which in this embodiment is cylindrical. It will be understood that the support surface 364 for the candle is circular in this embodiment and is located within the boundary defined by the wall portion 366. The candleholder also has a separate, non-combustible cover member 368 for placement over the candle and adapted for mounting on the base unit 362 during use of the candleholder. The cover member forms a top for the candleholder and it has a peripherally-extending wall section 370 that extends downwardly from the top. It will be seen that in this embodiment, the wall portion 366 has a substantially greater height than the wall section 370 of the cover member. Furthermore, in this embodiment, the openings 34 are formed in the wall portion 366 of the base unit and not in the cover member.

The preferred base unit 362 is provided with an outwardly projecting rim 372 extending around the exterior of the wall portion. In this candleholder, the rim can be an integral extension of the wall portion 366 and a suitable inscription can be written or painted on top of the rim, if desired. In order to strengthen the base unit and in particular the rim portion, the rim can be provided with a downwardly extending annular flange at 374. The various edges of this portable candleholder are preferably rounded or formed in a manner that they are not sharp and will not present a significant danger of cutting the user. The preferred materials for a disposable type candleholder 360 include aluminum sheet, aluminum foil material, and tin plate. This material can be powder coated in order to provide an alternative color to the normal color of the metal material. A suitable inscription or design can be printed on the candleholder by silk screen printing and/or use of labels. Although the candleholder 360 as shown with a round or cylindrical shape, including a base unit that is round in plan view and a round top, it will be understood that other shapes for candleholders constructed in this manner are also possible, including rectangular and square candleholders.

In the illustrated embodiment of FIG. 23, the cover member 368 is formed with four pie-shaped cut outs 380 in the top, these being distributed evenly around the top. If the candleholder 360 is intended for indoor use only, the openings or holes 380 located in the top can be open and this has the advantage of allowing heat to readily escape from the candleholder as well as smoke from the candle. In the case of a candleholder intended for use outdoors, it is possible to cover the holes 380 on the inside with a suitable transparent, non-combustible material which will allow the candlelight to be seen from the top and yet will prevent rain and water from entering the candleholder through the top.

In the preferred candleholder 360, the interior diameter of the wall section or annular flange 370 corresponds closely to the exterior diameter of the wall portion 366. In this way, the cover member will fit snugly on top of the base unit. If desired, a friction-type fit can be provided to help hold the cover member on the base unit.

It will be understood that in the candleholder 360, the openings 34 are also formed by partially cutting out and bending inward a small section of the wall portion 366 so as to permit air either to enter through or exit out of the opening while also changing the direction of air flow of incoming air in order to help prevent the candle from being extinguished. In this embodiment as well, at least one row of the openings 34 are located at a height corresponding approximately to the height of the candle when the candle is mounted on the support surface 364. In the illustrated embodiment, there are two rows of the openings 34 with the upper row of openings 34 being located at a height corresponding approximately to the initial height of the candle.

The candleholder 360 as shown is provided with an optional and separate lifting member 382 which has a magnetic base 384. It will be understood that the magnetic base 384 is only used in the case where the cover member 368 is made of a metal that is attracted to the magnetic base, ie. iron, steel, and nickel. The lifting member 382 can be used to lift the cover member and remove same from the base unit by attaching the magnetic base to the top formed by the cover member. The illustrated lifting member is designed to form the letters P and X, this being the Peace of Christ symbol. Other possible designs for the upper portion of the lifting member include the letter combination PG (meaning Peace Glow), a fish design and various possible Peace signs.

It will be clear and apparent to those skilled in this art that various modifications and changes can be made to the described and illustrated candleholders without departing from the spirit and scope of this invention. Accordingly, all such modifications and changes as fall within the scope of the appended claims are intended to be included and are part of this invention.

The invention claimed is:

1. A candleholder comprising:

a base unit for holding a candle, said base unit being a tray forming a bottom surface, which provides a horizontally extending support surface for a candle, and having an upstanding wall portion extending upwardly from a support surface; and a separate, non-combustible cover member for placement over said candle and for mounting on said base unit during use of the candleholder, said cover member forming a top and having a peripherally extending wall section that extends downwardly from said top, said upstanding wall portion being relatively short in height compared to said cover member;

said peripherally extending wall section of said cover member having a plurality of openings located between said support surface and said top, each opening formed by partially cutting out and bending inward a small section of said peripherally-extending wall section so as to permit air either to enter through or exit out of said openings while also changing the direction of airflow of incoming air in order to help prevent the candle from being extinguished, at least some of said openings being located at a height corresponding approximately to the height of the candle when the candle is mounted on said support surface so that the candle flame can be seen through at least some of said openings during use of the candleholder, wherein, during use of said candleholder, said upstanding wall portion engages said peripherally extending wall section and thereby acts to hold said cover member on said base unit.

2. A candleholder according to claim 1 wherein said base unit has an outwardly projecting rim extending around the exterior of said wall portion.

3. A candleholder according to claim 1 wherein said base unit and said cover member are round in plan view and said upstanding wall portion is cylindrical.

4. A candleholder according to claim 1 wherein said openings are substantially crescent shaped, each small section being cut along a single arcuate line extending through an angle of more than 90 degrees and not more than 180 degrees as measured from a centrepoint of the arcuate line, in order to form each opening.

5. A candleholder according to claim 1 wherein said openings are arranged in one or more horizontally extending rows.

6. A candleholder comprising:

a base unit for holding candle, said base unit providing a horizontally extending support surface for a candle and having an upstanding wall portion extending upwardly from said support surface, said base unit having an outwardly projecting rim extending around the exterior of said wall portion, said rim being formed with holes that can be used during use of said candleholder to secure the candleholder to the ground by means of U-shaped wire anchors tat extend through said holes, at least several of said U-shaped wire anchors, each wire anchor having two parallel prongs that are spaced-apart a selected distance, said holes in said rim being arranged in pairs with one pair of said holes on each side of the tray, the prongs of each wire anchor being insertable a respective one of said pairs of holes in order to secure the candleholder to the ground:

a separate, non-combustible cover member for placement over said candle and for mounting on said base unit during use of the candleholder, said cover member forming a top and having a peripherally extending wall section that extends downwardly from said top, said candleholder formed by the combination of said base unit and said cover member having a plurality of openings located between said support surface and said top, each opening formed by partially cutting out and bending inward a small section of one of said upstanding wall portion and said peripherally-extending wall section so as to permit air either to enter through or exit out of said opening while also changing the direction of airflow of incoming air in order to help prevent the candle from being extinguished, at least some of said openings being located at a height corresponding approximately to the height of the candle when the candle is mounted on said support surface so that the candle flame can be seen through at least some of said openings during use of the candleholder, wherein, during use of said candleholder, said upstanding wall portion engages said peripherally extending wall section and thereby acts to hold said cover member on said base unit.

* * * * *